US005398665A

United States Patent [19]

Carlson

[11] Patent Number: 5,398,665

[45] Date of Patent: Mar. 21, 1995

[54] BALL LAUNCHING DEVICE

[76] Inventor: Philip R. Carlson, 2163 Crabapple Ct., Wilkesboro, N.C. 28697

[21] Appl. No.: 104,328

[22] Filed: Aug. 9, 1993

[51] Int. Cl.[6] ..... F41B 3/02

[52] U.S. Cl. ..... 124/17; 124/20.1; 124/41.1

[58] Field of Search ..... 124/16, 17, 20.1, 79, 124/35.1, 31, 80, 41.1, 20.3; 273/26 D, 29 A; 248/163.1

[56] References Cited

U.S. PATENT DOCUMENTS

| | | | |
|---|---|---|---|
| 300,415 | 6/1884 | Van Allen | 124/17 X |
| 1,456,356 | 5/1923 | Bentley . | |
| 2,357,165 | 8/1944 | Brady | 248/194 |
| 2,828,097 | 3/1958 | Faunce | 248/106 |
| 3,018,769 | 1/1962 | Parsoneault | 124/11 |
| 3,277,878 | 10/1966 | Pankratz | 124/20.1 |
| 3,802,409 | 4/1974 | Mike et al. | 124/20 R |
| 4,873,964 | 10/1989 | Bonoan | 124/20.1 |
| 5,012,790 | 5/1991 | Bates | 124/81 |
| 5,123,643 | 6/1992 | Heilhecker et al. | 273/26 |
| 5,154,515 | 10/1992 | Haynes | 124/20.1 |
| 5,249,564 | 10/1993 | Peachey | 124/17 |
| 5,257,615 | 11/1993 | Jones | 124/56 |
| 5,303,695 | 4/1994 | Shopsowitz | 124/17 |

OTHER PUBLICATIONS

Sports Tutor, Inc., "Sports Tutor," 1992, all pages.
Jugs, Inc., "JUGS," 1993, cover page.

*Primary Examiner*—Randolph A. Reese
*Assistant Examiner*—Harry C. Kim
*Attorney, Agent, or Firm*—W. Thad Adams, III

[57] ABSTRACT

A ball launching device includes a tripod, an elastic cord connected to the tripod, and a ball holder connected to the elastic cord. The tripod has first and second downwardly diverging front legs and a back leg. The first and second front legs define a ball launching passage therebetween. The elastic cord is connected to the first and second front legs for launching the ball through the passage. The ball holder is connected to the elastic cord for releasably holding the ball therein.

11 Claims, 12 Drawing Sheets

BALL LAUNCHING DEVICE

TECHNICAL FIELD AND BACKGROUND OF THE INVENTION

This invention relates to an adjustable and portable ball launching device. The device is particularly useful for producing line drives, pop flies, long flies, and ground balls to assist coaches in providing fielding practice for baseball and/or softball players. The ball launching device of the present invention may also be used as a pitching device for batting practice. Additionally, the invention may be applied to other sports for launching balls, such as footballs, soccer balls, tennis balls, and volleyballs.

As the popularity of baseball and other sports continues to increase on the junior and little-league level, the existence and nature of various ball launching devices has become more and more prevalent. Many of these devices, however, are complex, expensive, and essentially ineffective for use on this particular level of play.

Amateur coaches in youth leagues often find it difficult to properly instruct youngsters because of the limited resources and/or man-power available per team. Typically, one baseball coach is required to singly provide both batting practice and fielding practice to 10–20 players. This may become physically challenging for the coach, and often results in wasted time and player boredom. For some coaches, the inability to bat or pitch may create a virtually insurmountable obstacle to properly instructing the players in the art of hitting and fielding a baseball.

Thus, the present invention satisfies the long felt need of baseball teams and coaches by providing an effective fielding and batting instructional device which is both easy to operate and inexpensive. Unlike some devices of the prior art, the invention is light-weight and portable, and includes few component parts.

SUMMARY OF THE INVENTION

Therefore, it is an object of the invention to provide a ball launching device for softball or baseball fielding instruction.

It is another object of the invention to provide a ball launching device for pitching a baseball or softball to a batter.

It is another object of the invention to provide a ball launching device which may be used to launch a football, tennis ball, volleyball, or soccer ball.

It is another object of the invention to provide a ball launching device which can be manually adjusted to vary the launch trajectory of the ball.

It is another object of the invention to provide a ball launching device which is portable.

It is another object of the invention to provide a ball launching device which can be easily assembled and disassembled for convenient transport to and from a ball field.

It is another object of the invention to provide a ball launching device which is relatively inexpensive to manufacture.

It is another object of the invention to provide a ball launching device for launching balls with varying degrees of velocity, direction, and spin.

These and other objects of the present invention are achieved in the preferred embodiments disclosed below by providing a ball launching device including a tripod, a launching means connected to the tripod, and a ball holder connected to the launching means. The tripod has first and second downwardly diverging front legs and a back leg. The first and second front legs define a ball launching passage therebetween. The launching means is connected to the first and second front legs for launching the ball through the passage. The ball holder is connected to the launching means for releasably holding the ball therein.

According to one preferred embodiment of the invention, a first hinge cooperates with the first and second front legs at a top end of the tripod. The hinge connection permits adjustment of the divergence between the first and second front legs relative to each other, thus allowing the user to adjust the height and stability of the tripod, and the width of passage through which the ball is to be launched.

According to another preferred embodiment of the invention, a second hinge cooperates with the back leg at the top end of the tripod. The second hinge connection permits forward or backward adjustment of the back leg relative to the first and second front legs to thereby adjust the launch trajectory of the ball.

According to another preferred embodiment of the invention, the second hinge connection permits simultaneous adjustment of the divergence between the first and second front legs, and the back leg divergence with respect to the notional plane defined by the first and second front legs, the front leg divergence ranging between 20 degrees and 45 degrees.

According to yet another preferred embodiment of the invention, a leg stay prevents the first and second front legs and the back leg from diverging beyond a predetermined angle.

Preferably, the leg stay includes at least one rope connected to a respective foot portion of the first and second front legs and the back leg.

According to one preferred embodiment of the invention, the launching means comprises an elastic cord attached at respective ends to the first and second front legs of the tripod. The ball is launched through the passage by drawing the ball holder backwardly towards the back leg to create tension in the elastic cord, and then releasing the tension in the cord by releasing the ball holder.

According to another preferred embodiment of the invention, the first and second front legs have a respective eye bolt connected thereto. The eye bolt has an eye for which respective ends of the elastic cord are attached.

Preferably, the elastic cord is constructed of latex rubber tubing.

Preferably, the ball holder is a plastic cup.

According to one preferred embodiment of the invention, the tripod is constructed of wood.

According to another preferred embodiment of the invention, the tripod is a telescopic tripod. Each leg comprises nested tubes for being extended and locked rigidly together to form a relatively long leg, and for being nested one within the other to form a relatively short leg for easy transport. The legs may be nested or may simply connect together at an overlapping joint and held in place by a clamp, set-screw, bolt, or metal pin.

According to one preferred embodiment of the invention, the first and second front legs and the back leg of the tripod are 5 to 10 feet long, respectively.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
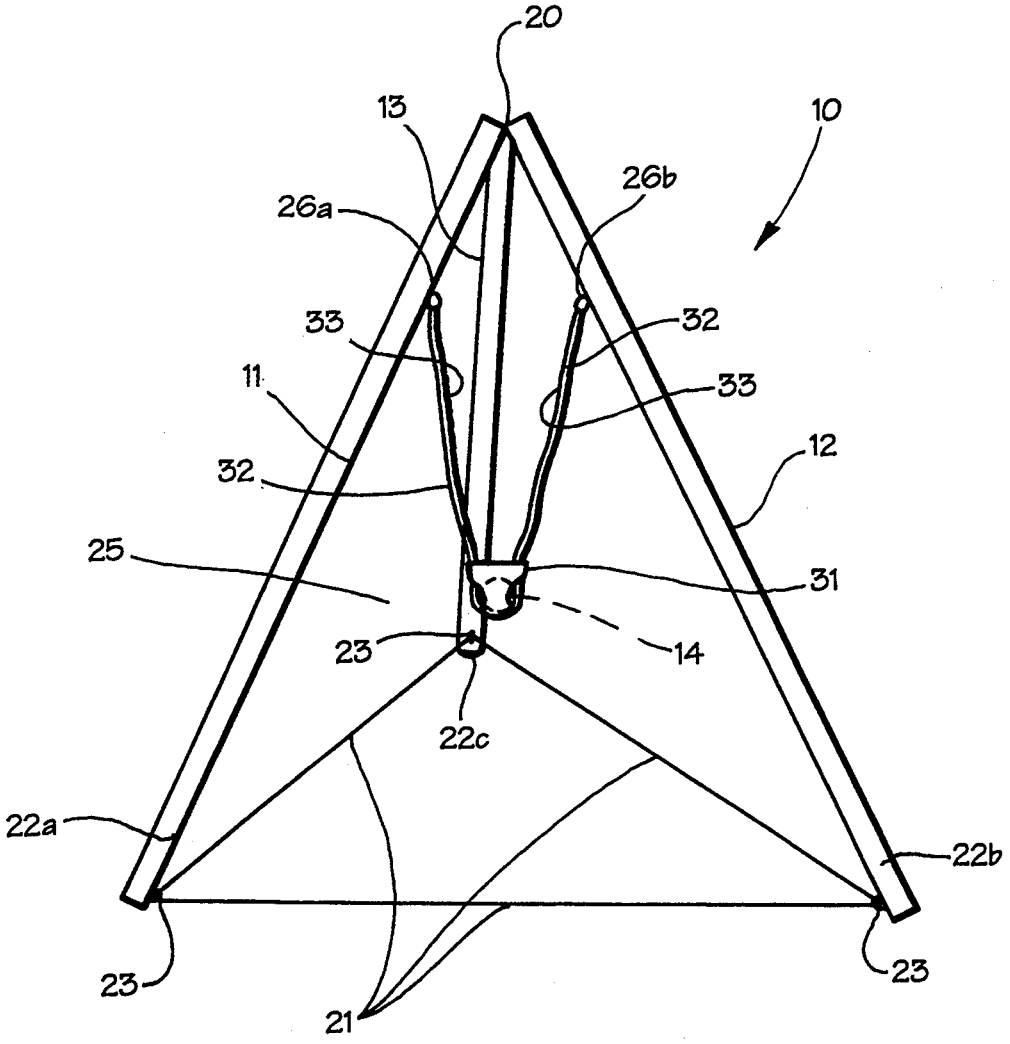
FIG. 1 is a front elevation of the ball launching device according to one preferred embodiment of the present invention.

Referring now specifically to the drawings, a portable ball launching device according to the present invention is illustrated in FIG. 1 and shown generally at reference numeral 10. The invention is particularly useful in softball or baseball fielding practice by launching line-drives, long flies, pop-ups, or grounders. The invention may also be used as a pitching device for batting practice. Additionally, the invention may used for instruction in other sports, such as football, tennis, volleyball, or soccer.

As shown in FIG. 1, the portable ball launching device 10 includes a tripod 20 having first and second front legs 11 and 12 and a back leg 13. Preferably, the first and second front legs 11, 12 of the tripod 20 are connected at the top of the tripod 20 by a conventional hinge 15 (See FIG. 2). The hinge 15 allows the first and second front legs 11, 12 to pivot inwardly and outwardly between an angle range of about 0 to 180 degrees.

Figure 2:
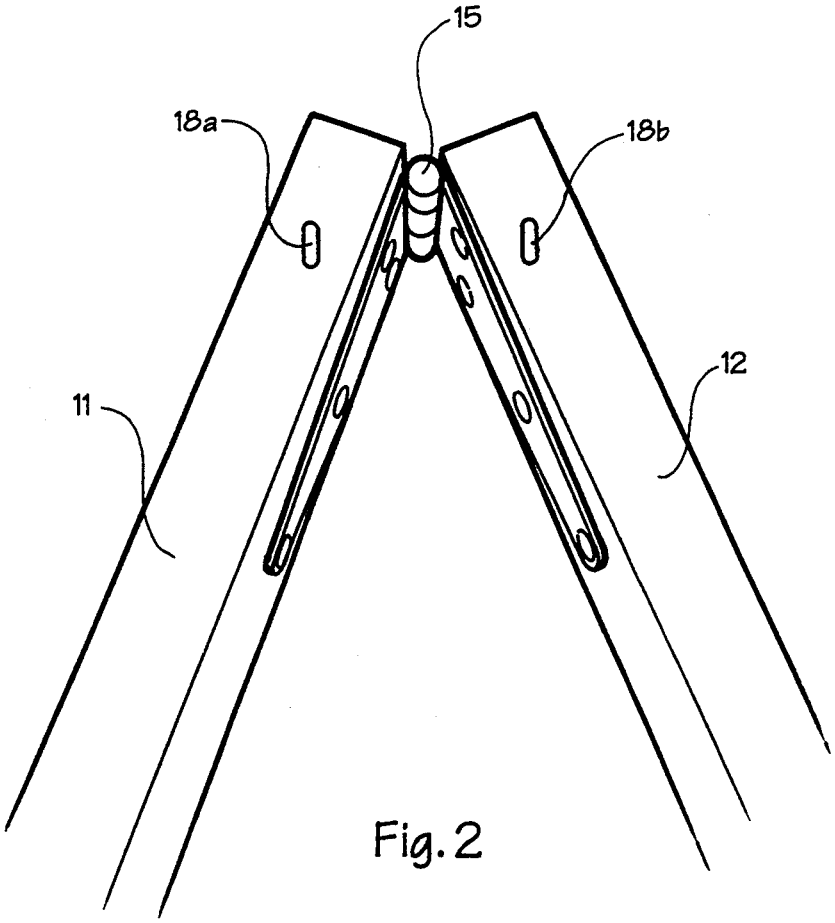
FIG. 2 is a perspective view of the hinge connecting the first and second front legs of the tripod.
Figure 3:
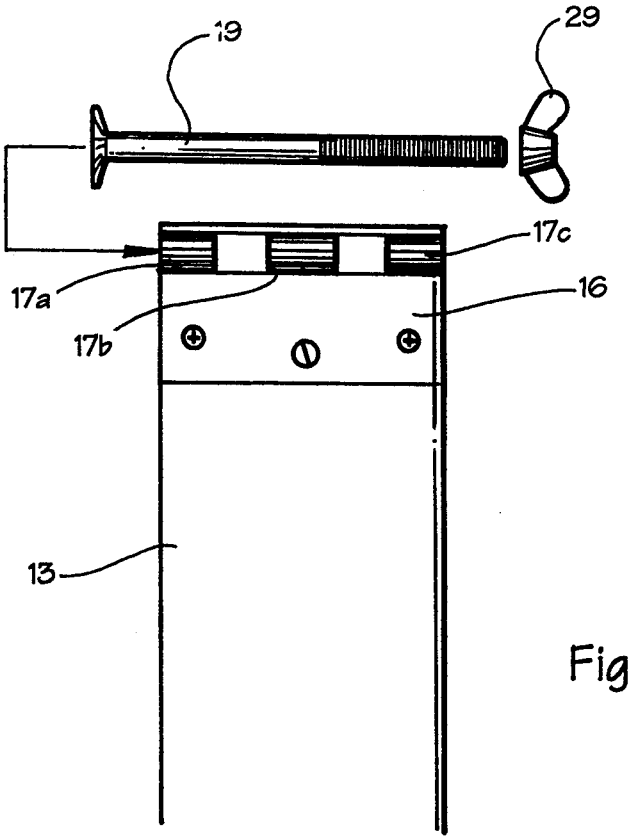
FIG. 3 is a view of the hinge plate and hinge pin of the hinge assembly for connecting the back leg to the first and second front legs of the tripod.
Figure 4:
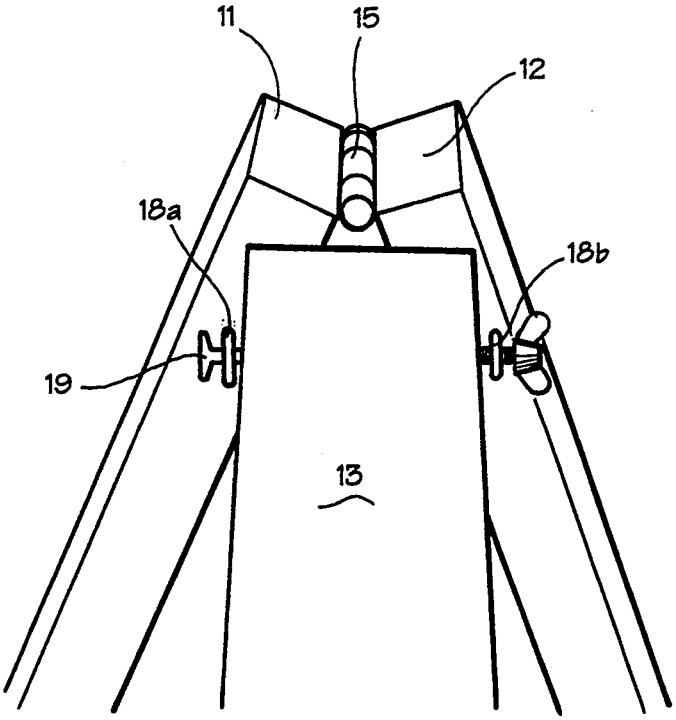
FIG. 4 is a fragmentary perspective view of the top portion of the tripod showing the connection between the front legs and back leg of the tripod.

The back leg 13 of the tripod 20 is preferably attached to the first and second front legs 11, 12 by a hinge assembly. As shown in FIGS. 2, 3 and 4, the hinge assembly includes a hinge plate 16 and hinge barrels 17*a–c* (See FIG. 3) connected to a top end of the back leg 13, and first and second eye bolts 18*a,b* (See FIG. 2) connected respectively to the first and second front legs 11, 12 of the tripod 20. The eye bolts 18*a,b* are preferably located approximately 2–4 inches from the top of the front legs 11 and 12. When positioned for assembly, the hinge barrels 17*a–c* substantially align with the respective eyes of the eye bolts 18*a,b*. A hinge pin 19 is inserted through the respective eyes bolts 18*a,b* and hinge barrels 17*a–c* to securely attach the back leg 13 to the first and second front legs 11, 12. A wing-nut 29 is preferably screwed to the threaded end of the hinge pin 19.

The tripod attachment is illustrated in FIG. 4. Preferably, the back leg 13 may be adjusted between an angle range of about 0 degrees to 90 degrees with respect to the notional plane defined by the first and second front legs 11, 12.

Figure 5:
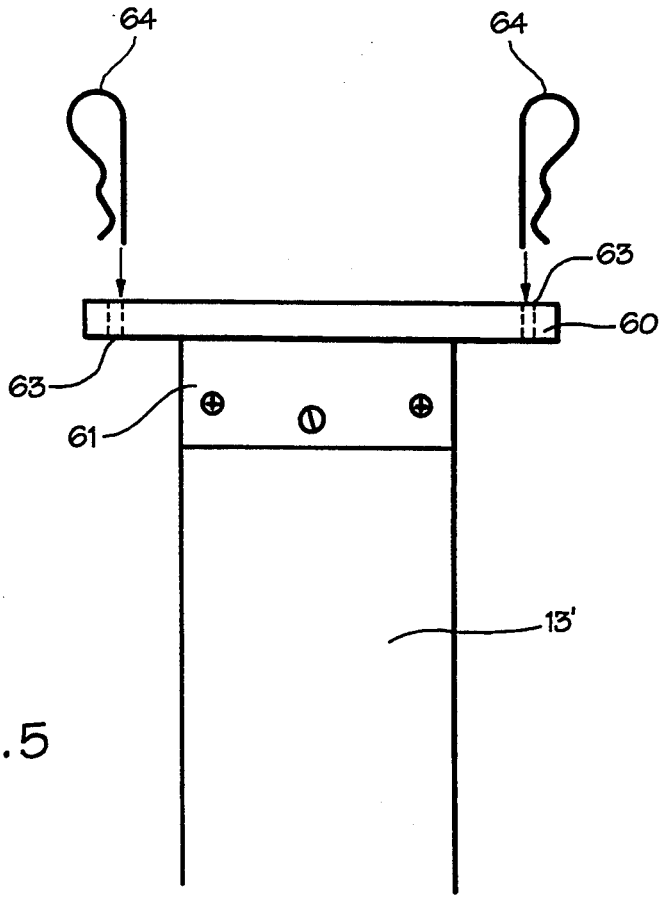
FIG. 5 is a view of the hinge plate and hinge pin for connecting the back leg to the first and second front legs of the tripod according to an alternate embodiment.
Figure 6:
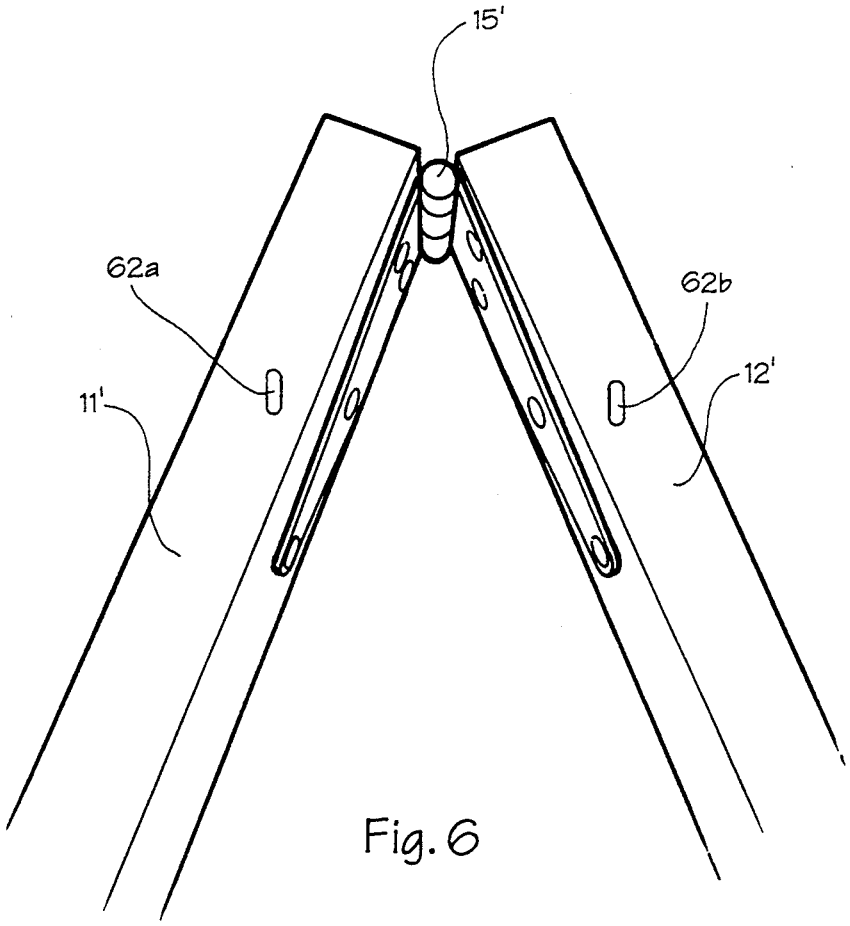
FIG. 6 is a perspective view of the hinge connecting the first and second front legs of the tripod, showing the location of respective eye bolts according to the alternate embodiment of the invention shown in FIG. 5.
Figure 7:
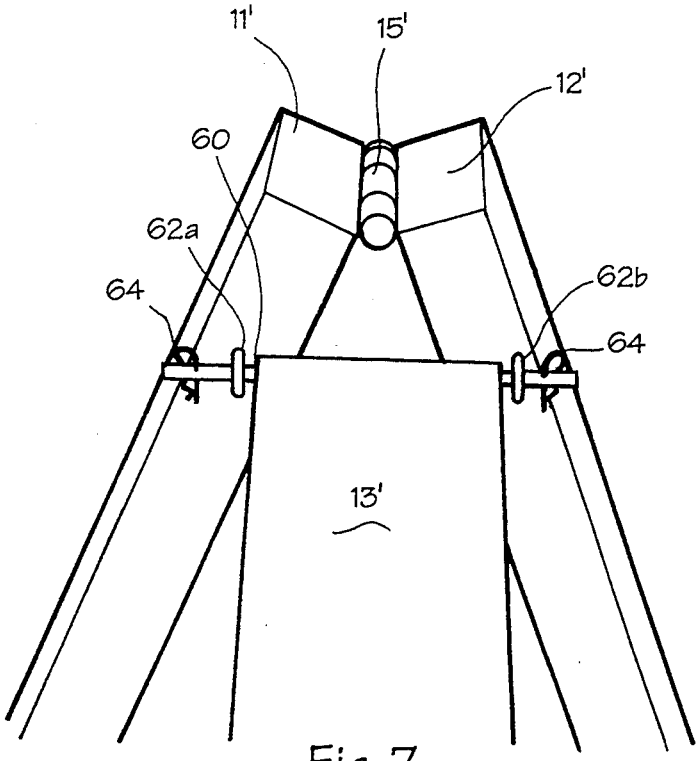
FIG. 7 is a fragmentary perspective view of the top portion of the tripod showing the alternate connection between the front legs and back leg of the tripod.

An alternate means for attaching the back leg 13' to the first and second front legs 11' and 12' is illustrated in FIGS. 5, 6, and 7. This embodiment permits simultaneous adjustment of the divergence of the first and second front legs 11' and 12' and the angle formed between the back leg 13' and notional plane defined by the first and second front legs 11' and 12'. According to this embodiment, a hinge pin 60 is permanently attached to a hinge plate 61. To connect the back leg 13' to the first and second front legs 11' and 12' the respective ends of the hinge pin 60 are threaded through eye bolts 62*a* and 62*b* of the first and second front legs 11' and 12'. As shown in FIG. 6, the eye bolts 62*a,b* are preferably located approximately 4–6 inches from the top of the front legs 11' and 12'. Additionally, each end of the hinge pin 60 has a through bore 63 into which respective cotter pins 64 are inserted (See FIG. 5). The cotter pins 64 serve to prevent the hinge pin 60 from slipping from the eye bolts 62*a,b* of the first and second front legs 11' and 12'. The tripod attachment according to this embodiment is illustrated in FIG. 7. Like elements are referenced above in prime notation.

Figure 8:
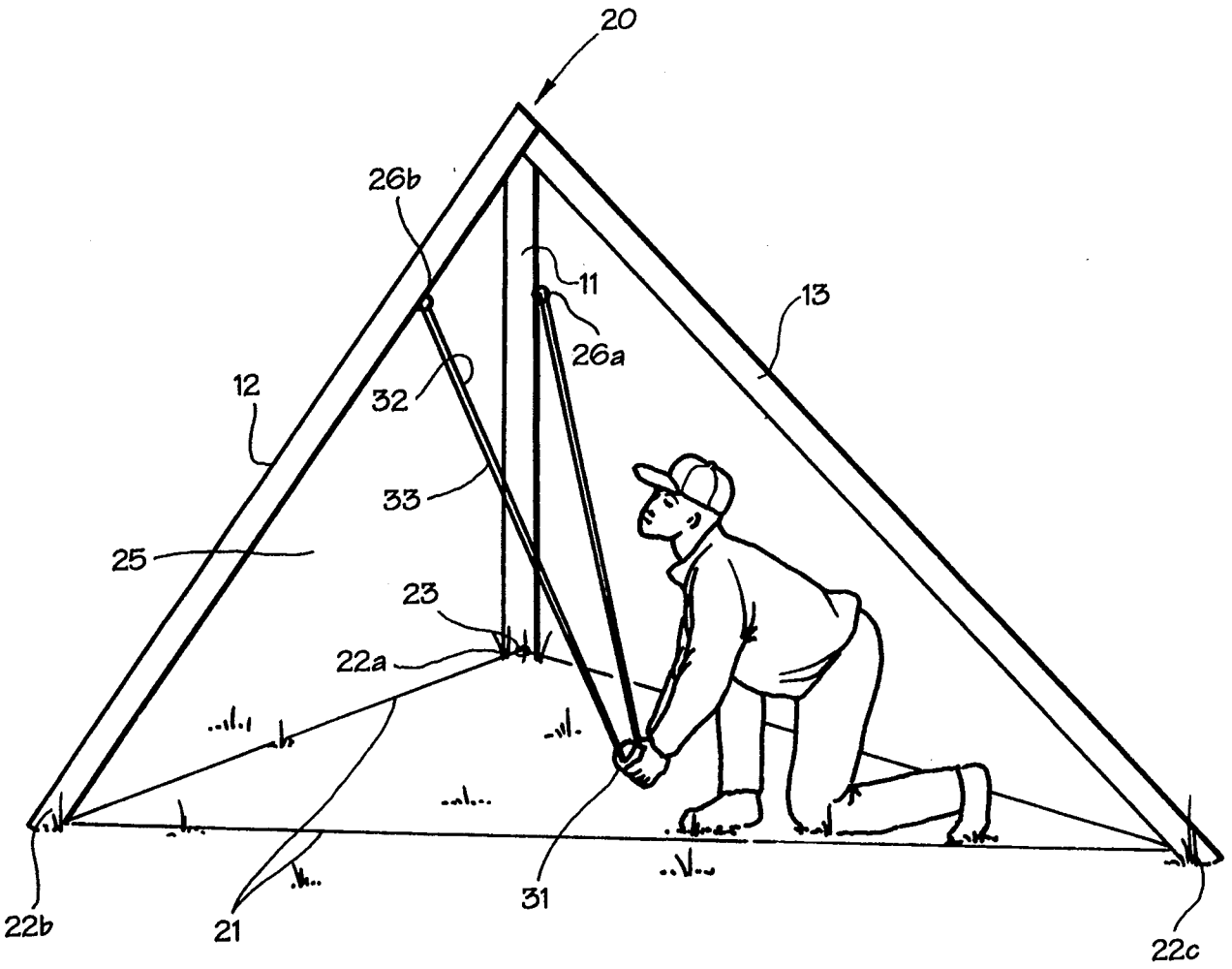
FIG. 8 is a side elevation of the invention showing the tripod legs disposed for launching a pop fly or long fly ball.

When mounted for launching a fly ball as shown in FIG. 8, the first and second front legs 11, 12 of the tripod 20 are preferably fixed at a substantially 45 degree angle. The resulting opening formed between the first and second front legs 11, 12 defines a passage 25 through which a ball 14 can pass when launched. The angle between the front legs 11, 12 and the back leg 13 can be varied depending upon the desired ball launch trajectory. For example, the greater the angle between the back leg 13 and the front legs 11, 12, the more suitable the ball launching device 10 is for launching a line-drive. Preferably, the back leg 13 is adjusted to form an approximate 90 angle with respect to the notional plane defined by the first and second front legs 11 and 12.

Referring again to FIG. 1, a leg stay 21 is connected to respective feet 22*a–c* of the tripod 20 to prevent the legs 11, 12, and 13 from spreading beyond a predetermined angle. Preferably, an eye bolt 23 is connected to each foot 22*a–c* for attaching the leg stay 21 thereto. The leg stay 21 may be a rope constructed of nylon, cloth, or of any other suitable material.

Figure 9:
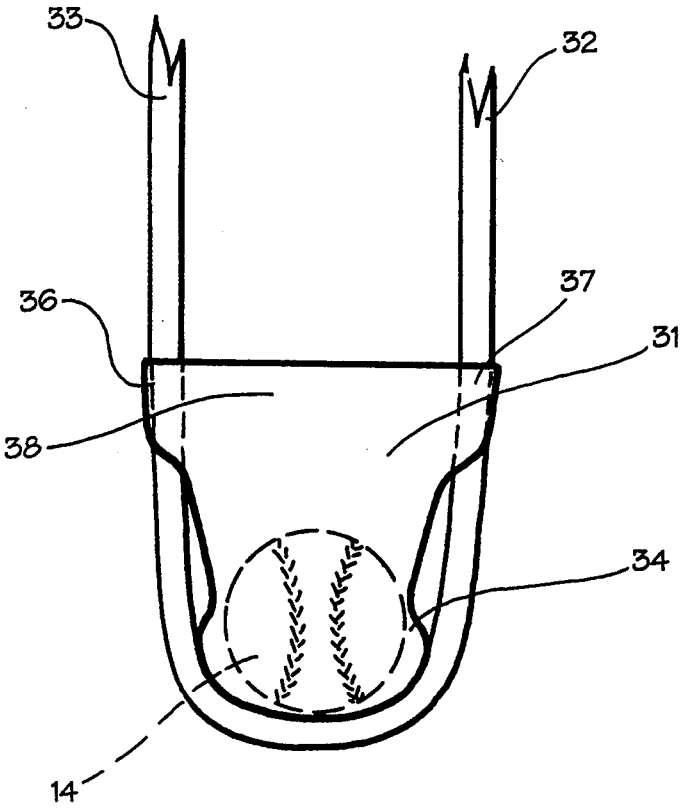
FIG. 9 is a side view of the ball holder connected to the elastic cords showing the ball in phantom.
Figure 10:
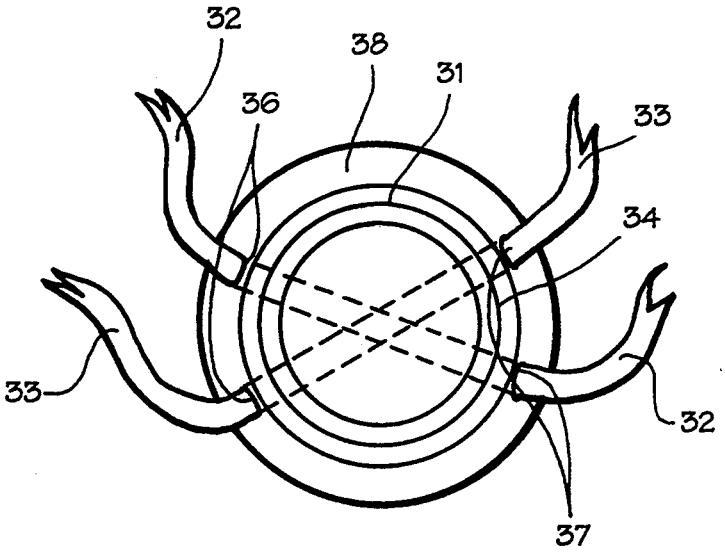
FIG. 10 is a top plan view of the ball holder shown in FIG. 9.

A ball holder 31, as illustrated in FIGS. 9 and 10, is connected to a pair of elastic cords 32 and 33 attached to the first and second front legs 11, 12 of the tripod 20. The ball holder 31 is preferably an open-topped and conical-shaped plastic cup. According to one embodiment, the diameter of the ball holder 31 is approximately 4½ inches at the top opening tapering down to a base diameter slightly larger than the ball 14 being launched, i.e., baseball, softball, or tennis ball. A larger diameter ball holder 31 would be necessary for launching balls such as soccer balls and footballs. The ball holder 31 preferably has an annular lip 34 formed at the base for allowing easier gripping, retraction, and release of the ball holder 31. Alternately, the ball holder 31 may include a handle or loop (not shown) at the base.

Preferably, each of the first and second front legs 11, 12 has respective eye bolts 26*a* and 26*b* connected thereto to which respective ends of the elastic cords 32, 33 can be tied or otherwise attached (See FIG. 1). According to one embodiment, the eye bolts 26*a* and 26*b* are located respectively on the first and second front legs 11, 12 approximately one-fourth (¼) the distance from the top of the tripod 20.

The elastic cords 32, 33 are attached to the ball holder 31 by first attaching respective free ends of the cords 32, 33 to the eye bolt 26*a* of the first front leg 11 of the tripod 20, and then threading the respective opposite ends of the cords 32, 33 through a first set of holes 36 formed in the top rim 38 of the ball holder 31. The cords 32, 33 are then passed around the outside of the of the ball holder 31 at the base, and back through a second set of holes 37 in the top rim 38 of the ball holder 31. The opposite free ends of the respective cords 32, 33 are then attached to the eye bolt 26*b* of the second front leg 12 of the tripod 20.

Figure 11:
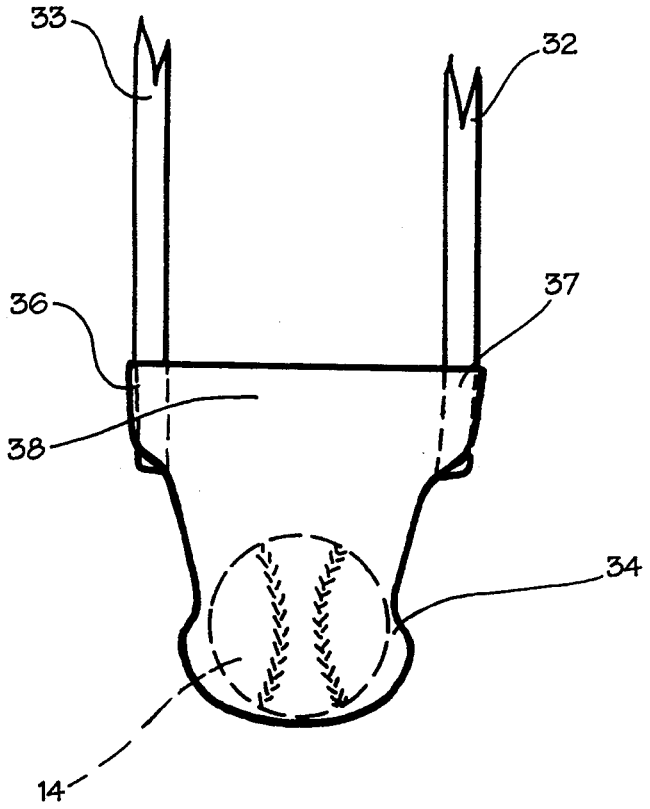
FIG. 11 is a side view of the ball holder connected to the elastic cords according to an alternate embodiment.
Figure 12:
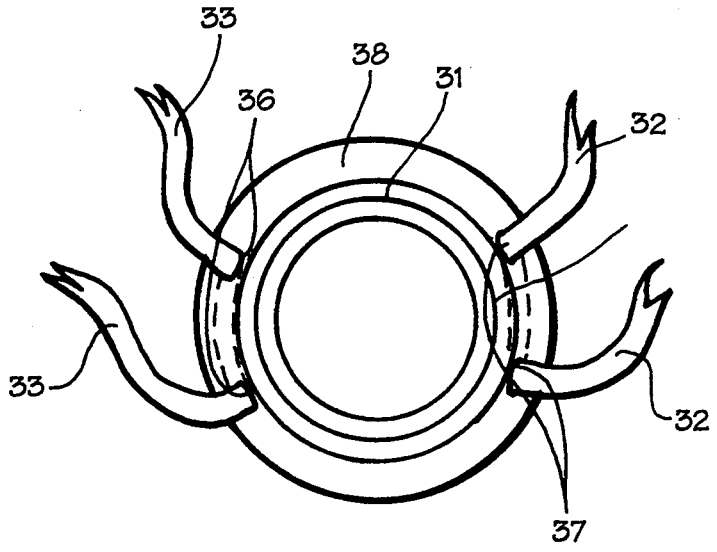
FIG. 12 is a top plan view of the ball holder shown in FIG. 11.

Alternately, the ball holder may be attached as shown in FIGS. 11 and 12. Instead of passing the cords 32 and 33 around the outside of the ball holder 31 as previously described, the cord 32 is looped through the first set of holes 36 and the cord 33 is looped through the second set of holes 37.

According to one embodiment, the distance between the eye bolts 26*a* and 26*b* and the ball holder 31 is approximately 23 inches when the cords 32, 33 are in the relaxed, unstretched position. By using a cord of one-quarter (¼) inch O.D. 3/32 inch I.D. latex rubber tubing, a modulus of approximately 75 pounds may be attained as the ball holder 31 is retracted from the 23 inch relaxed state to a 64 inch stretched state.

The ball launch distance and height are proportionate to the length of retraction of the plastic ball holder 31, and the amount of applied tension in the elastic cords 32, 33. The approximate maximum range of the ball launching device 10 having two elastic cords 32, 33 made from one-quarter (¼) inch O.D. latex rubber tubing is 300 feet with a maximum approximate altitude of 100 feet. Additionally, the launch distance and height may be varied by changing the length of the elastic cords 32, 33 and/or the cord diameter.

Figure 13:
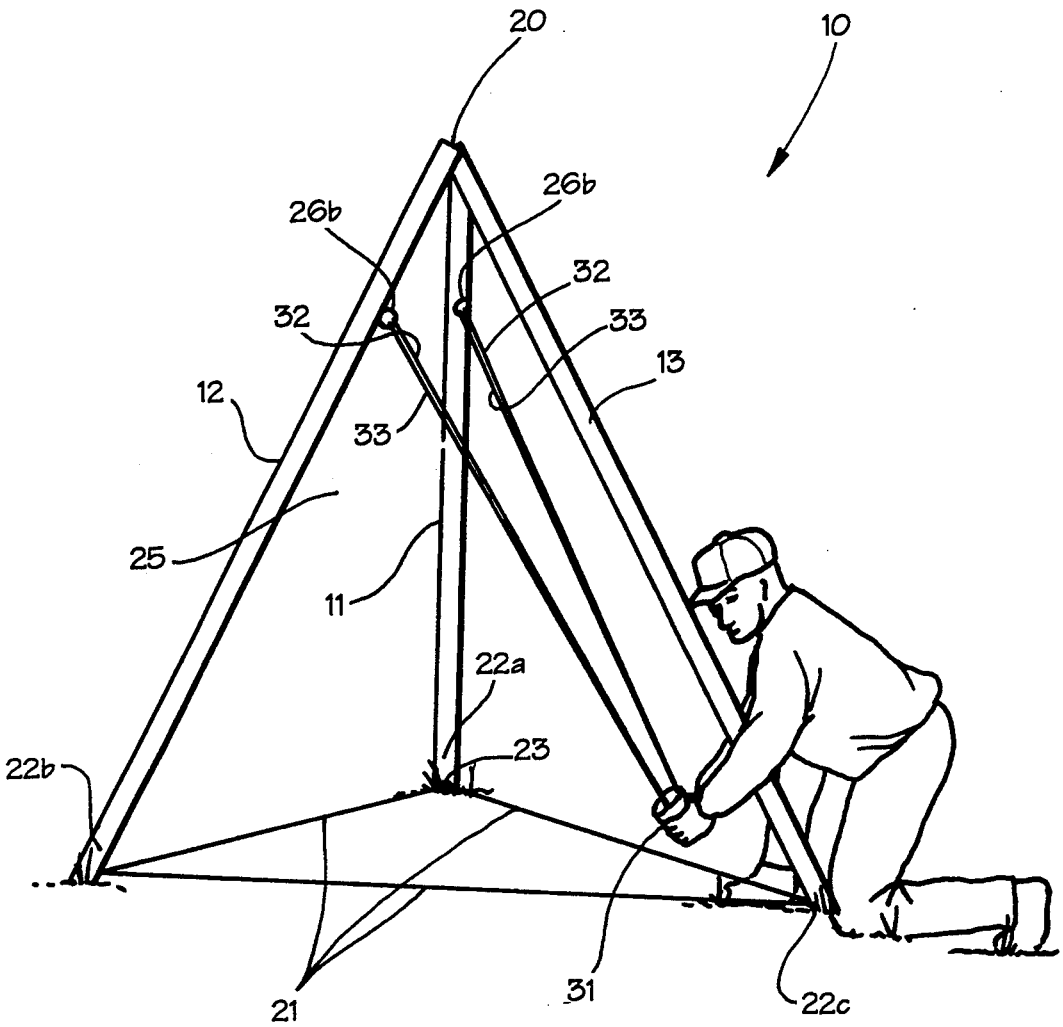
FIG. 13 is a side elevation of the invention illustrating the elastic cords in a tensioned condition with the ball holder in a retracted position just prior to launching the ball.
Figure 14:
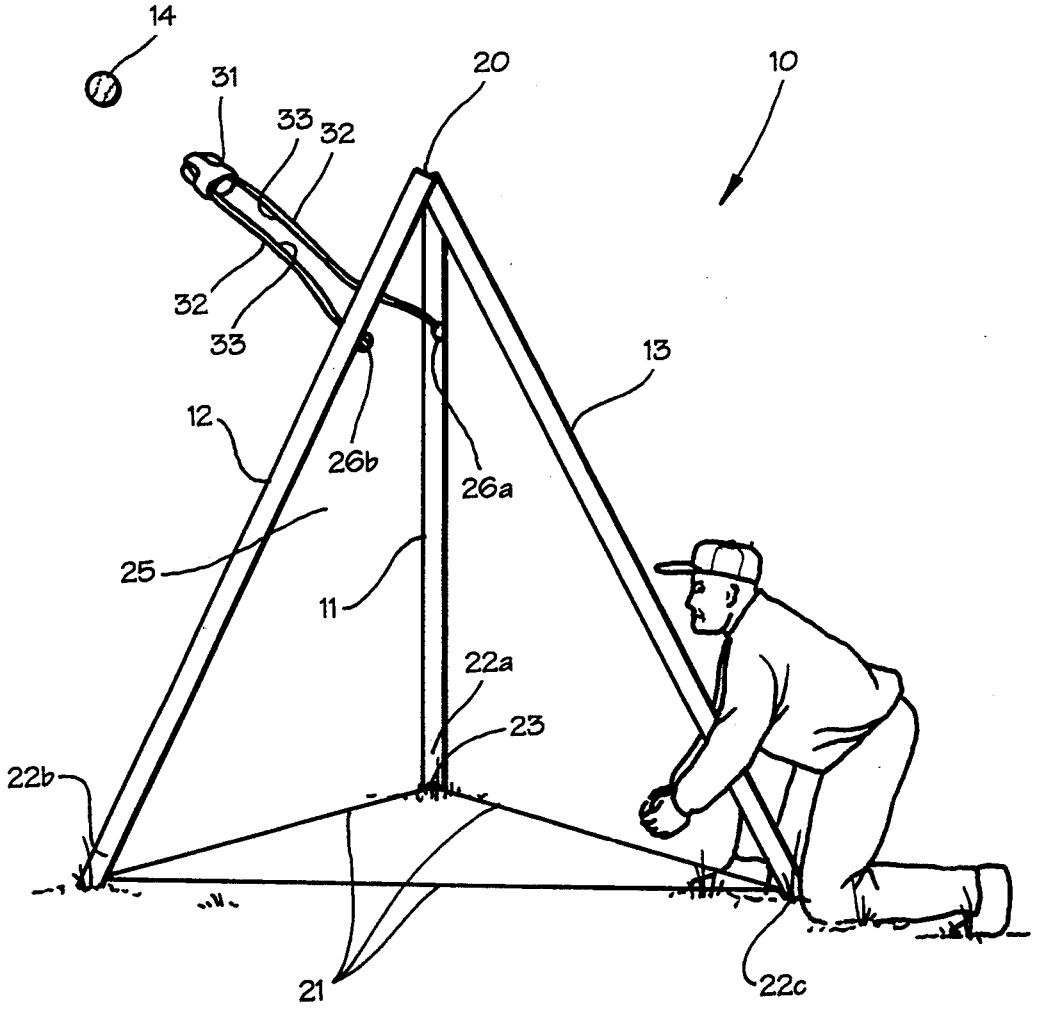
FIG. 14 is a side elevation of the invention illustrating the ball launch immediately after the ball holder has been released.

Referring to FIGS. 13 and 14, to launch a ball 14, the user places the ball 14 in the ball holder 31 attached to the first and second front legs 11, 12 of the tripod 20. The base lip 34 of the ball holder 31 is then grasped, and manually pulled back to create tension in the elastic cords 32, 33, as shown in FIG. 13. When the ball holder 31 is released, the tension in the cords 32, 33 is released and the ball 14 is thereby launched forwardly through the passage 25 defined by the first and second front legs 11, 12 of the tripod 20, as shown in FIG. 14. A pop fly may be produced by pulling the ball holder 31 downwardly perpendicular with the ground, while a long fly ball may be produced by pulling the ball holder 31 backwards and downwards approximately parallel with the back leg 13 of the tripod 20. To reproduce a particular fly ball, graduated marks (not shown) may be printed on the back leg 13 of the tripod 20 to measure the exact length of the ball holder 31 retraction. Spin may be placed on the ball 14 by rotating the retracted ball holder 31 up to 180 degrees just before release.

The launch trajectory of the ball 14 is varied by adjusting the angle of the back leg 13 of the tripod 20 relative to the first and second front legs 11, 12. Additionally, the trajectory may be varied by changing the angle at which the elastic cords 32, 33 are stretched prior to launching.

Figure 15:
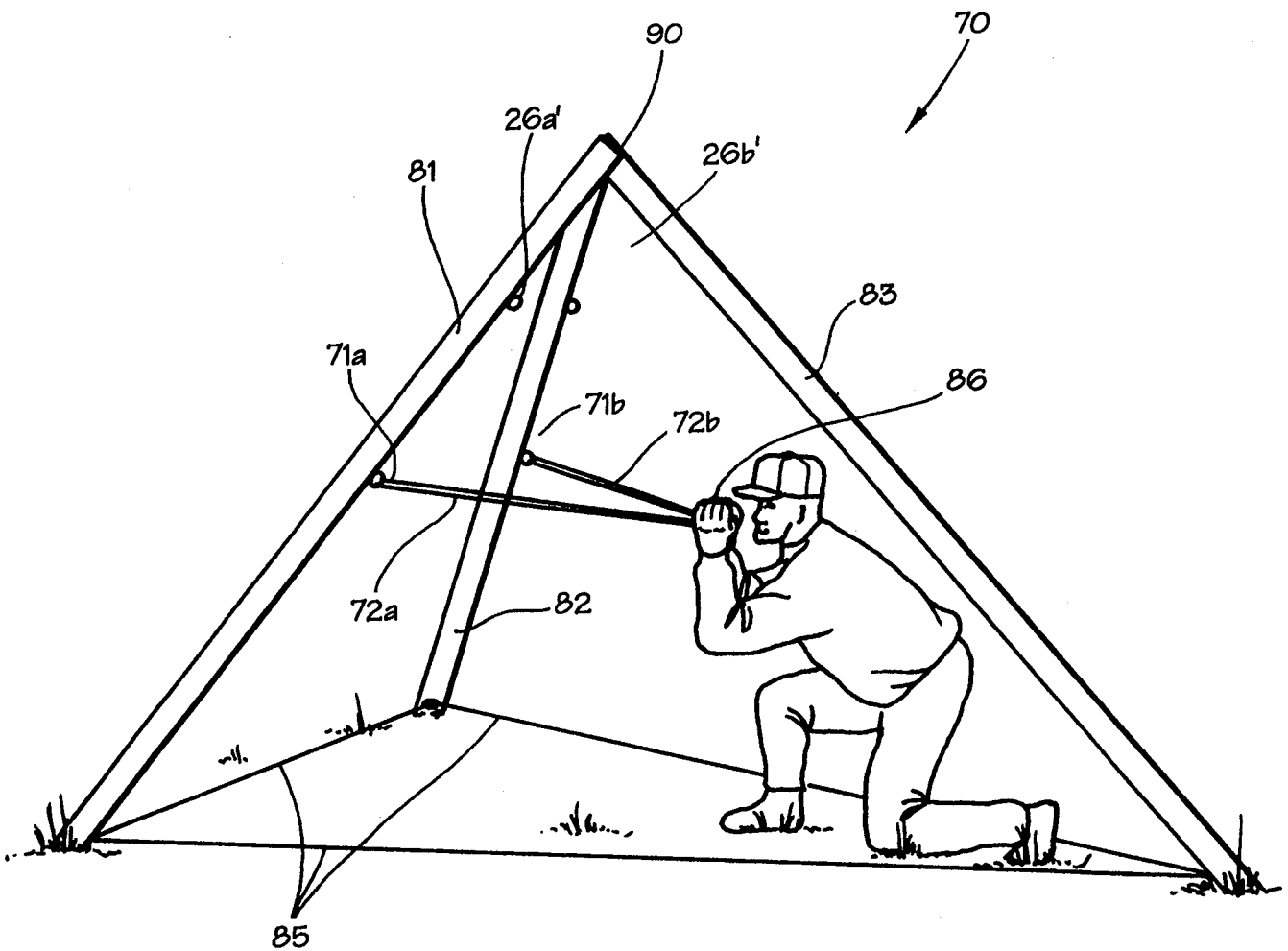
FIG. 15 is a side elevation of an alternate embodiment of the invention particular for launching line-drives, or for pitching.

Referring to FIG. 15, to use the ball launching device 70 for pitching balls to a batter or for launching line-drives, an additional set of eye bolts 71*a* and 71*b* for attaching respective ends of elastic cords 72*a* and 72*b* is preferably included on first and second front legs 81 and 82 of the tripod 90. The added set of eye bolts 71*a* and 71*b* are connected to the front legs 81 and 82 approximately one-half the distance from the top of the tripod 90. The back leg hinge alternate illustrated in FIGS. 5, 6, and 7 is utilized, thus allowing adjustment of front leg divergence to 20 degrees. The leg stay 85 located at the foot of the front legs 81 and 82 is adjusted to maintain the approximate 20 degree angle between the first and second front legs 81, 82. The back leg 83 is adjusted to form an approximate 90 degree angle with respect to the notional plane defined by the first and second front legs 81, 82. For additional support and stability, equal additional weight may be added to the tripod legs 81, 82, and 83 or a single weight of about 10 pounds may be suspended from the back leg 83 at the top of the tripod 90. By pulling the ball holder 86 backwardly towards the back leg 83, a maximum ball speed of about 30 to 60 mph can be attained with a relatively high degree of accuracy.

Although FIG. 15 illustrates the use of only one set of cords 72*a,b* and ball holder 86, a second set of cords and ball holder (not shown) may be attached to eye bolts 26*a'* and 26*b'* of the tripod 90 . Thus, the user is not required to change the cords 72*a,b* from respective sets of eye bolts in order to launch either pop flies or pitches.

According to one embodiment, the height of the tripod 20 is approximately eight feet to maximize launch accuracy and distance. However, the height may be either increased or decreased depending on the particular use application. For example, if the ball launching device 10 is used for lobbing tennis balls, the tripod 20 could be considerably shorter, since a lesser degree of force would be necessary to launch the tennis ball. Furthermore, a shorter tripod having larger diameter cords could be used for launching balls a considerable distance and height. However, launch accuracy would decrease with decreasing height of the tripod and length of the ball retraction.

Figure 16:
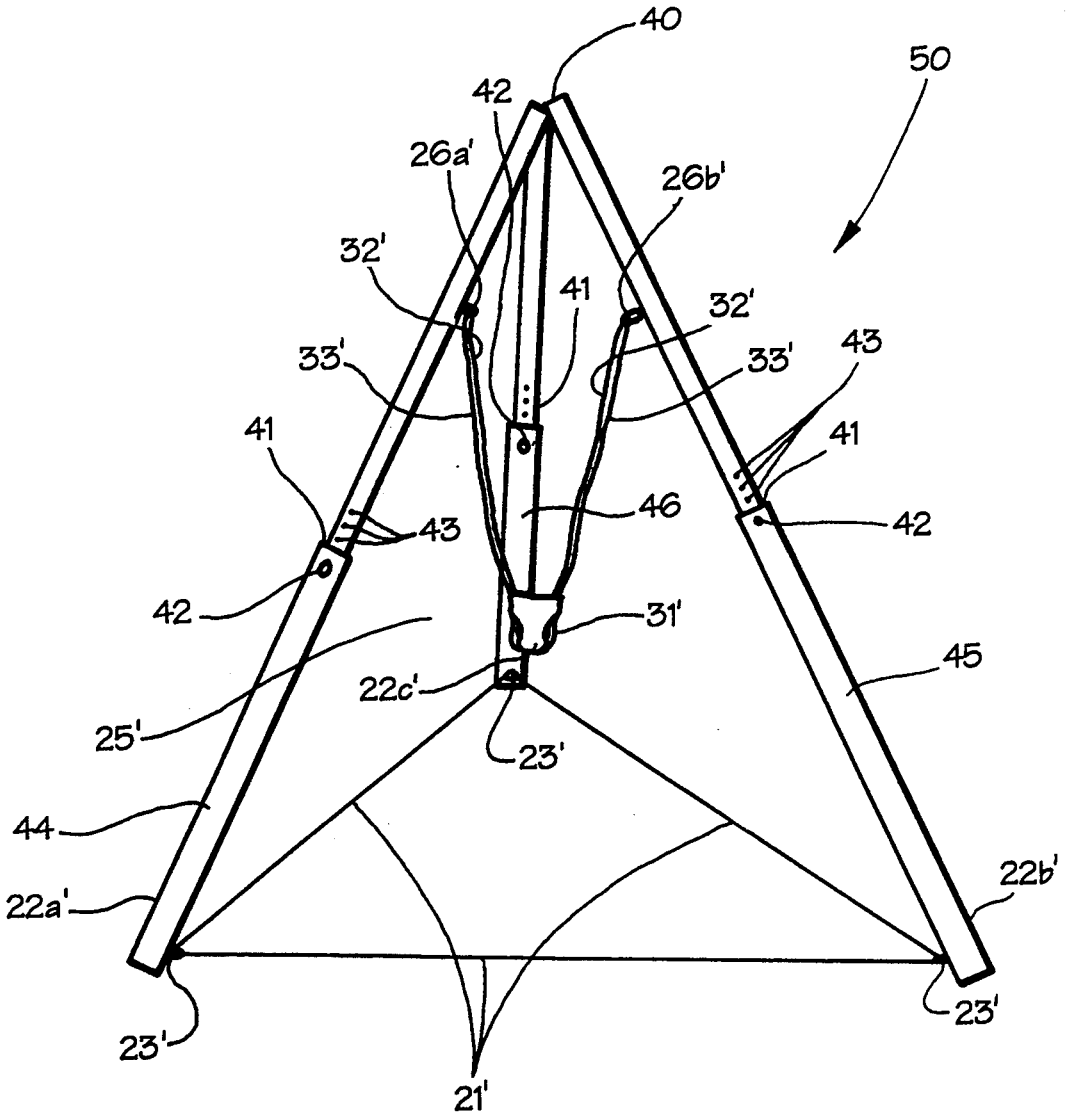
FIG. 16 is a front elevation of the ball launching device according to an alternate embodiment of the invention.
Figure 17:
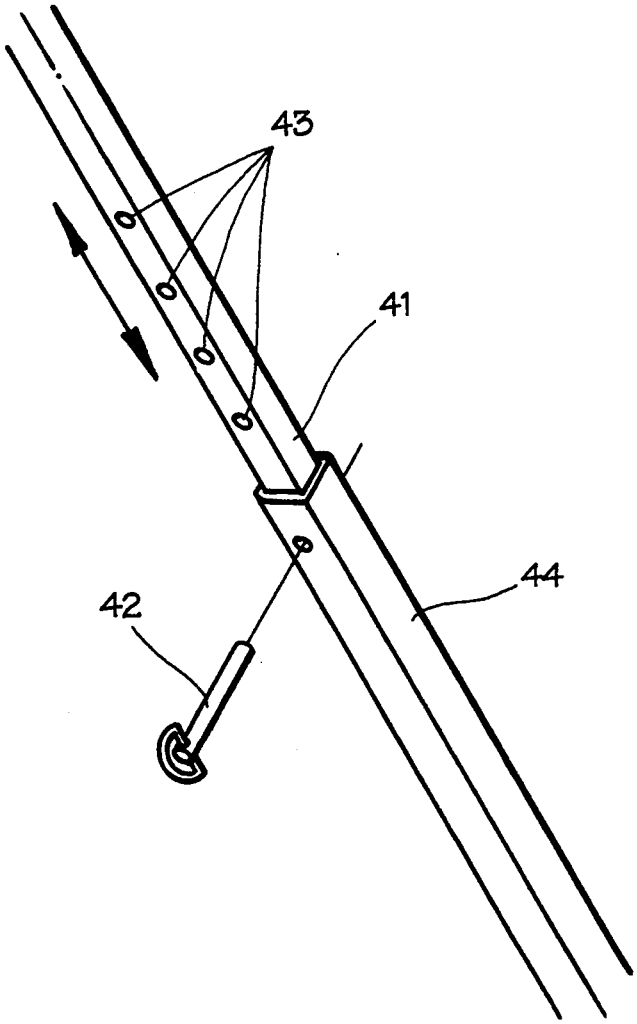
FIG. 17 is a fragmentary perspective view of a leg of the tripod according to the alternate embodiment of the invention shown in FIG. 16.

As shown in FIGS. 16 and 17, a telescopic tripod 40 may be used to simplify transport of the ball launching device 50. According to this embodiment, the three legs 44, 45, and 46 of the tripod 40 are segmented, and connected at a telescoping joint 41 with a pin 42 or setscrew (not shown). Several holes 43 are preferably formed in the nested leg for receiving the pin 42, thereby permitting length adjustment of the tripod 40. To provide convenient transport of the ball launching device 50, the segmented legs 44, 45, and 46 may be separated at their respective telescoping joints 41. Preferably, the legs 44, 45, and 46 are constructed of tubular steel, fiberglass, or aluminum, and are connected together by respective hinges as previously described. According to an alternate embodiment (not shown), the respective segments of legs 44, 45, and 46 may be joined by respective couplings. Like elements illustrated and described above with reference to the ball launching device 50 are indicated in prime notation.

A portable ball launching device is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A ball launching device, comprising:

(a) a tripod mounted on a supporting surface and having first and second downwardly diverging front legs and a back leg, said first and second front legs defining a ball launching passage therebetween;

(b) launching means connected to said first and second front legs for launching a ball through said passage;

(c) a ball holder connected to said launching means for releasably holding the ball therein; and (d) hinge means connected to said first and Second front legs at a top end of said tripod for permitting adjustment of the divergence between said first and second front legs relative to each other, and to thereby adjust the height and stability of the tripod.

2. A ball launching device according to claim 1, and including second hinge means connected to said back leg at the top end of said tripod for permitting forward or rearward adjustment of said back leg relative to said first and second front legs to thereby adjust a launch trajectory of the ball.

3. A ball launching device according to claim 2, further comprising a leg stay for preventing said first and second front legs and said back leg from diverging beyond a predetermined angle.

4. A ball launching device according to claim 3, wherein said leg stay comprises at least one rope connected to a respective foot portion of said first and second front legs and said back leg.

5. A ball launching device according to claim 1, wherein said launching means comprises an elastic cord attached at respective ends to said first and second front legs of the tripod, whereby the ball is launched through said passage by drawing said ball holder backwardly towards said back leg or downwardly towards the supporting surface to create tension in said elastic cord, and then releasing the tension in said cord by releasing said ball holder.

6. A ball launching device according to claim 5, wherein said first and second front legs have a respective eye bolt connected thereto, said eye bolt having an eye for which respective ends of said elastic cord are attached.

7. A ball launching device according to claim 6, wherein said elastic cord is constructed of latex rubber tubing.

8. A ball launching device according to claim 1, wherein said ball holder comprises a plastic cup.

9. A ball launching device according to claim 1, wherein said tripod is constructed of wood.

10. A ball launching device according to claim 1, wherein said tripod is a telescopic tripod; each leg comprising nested tubes for being extended and locked rigidly together to form a relatively long leg, and the tubes of said each leg being nested one within the other to form a relatively short leg for easy transport of the ball launching device.

11. A ball launching device according to claim 1, wherein each one of the legs of said tripod is between 5 to 10 feet long.

* * * * *